United States Patent [19]

Houtkamp

[11] 4,275,326

[45] Jun. 23, 1981

[54] IMAGE INTENSIFIER TUBE WITH A LIGHT-ABSORBING ELECTRON-PERMEABLE LAYER

[75] Inventor: Johannes J. Houtkamp, Delft, Netherlands

[73] Assignee: N.V. Optische Industrie "De Oude Delft", Delft, Netherlands

[21] Appl. No.: 118,690

[22] Filed: Feb. 5, 1980

Related U.S. Application Data

[62] Division of Ser. No. 841,067, Oct. 11, 1977, Pat. No. 4,201,797.

[30] Foreign Application Priority Data

Oct. 20, 1976 [NL] Netherlands ..... 7611593

[51] Int. Cl.[3] ..... H01J 29/28; H01J 31/50

[52] U.S. Cl. ..... 313/102; 313/466

[58] Field of Search ..... 313/102, 466

[56] References Cited

U.S. PATENT DOCUMENTS

| | | | |
|---|---|---|---|
| 3,254,253 | 5/1966 | Davis et al. | 313/102 |
| 3,692,576 | 9/1972 | Takayanagi et al. | 313/466 X |
| 4,155,024 | 5/1979 | Sonoda | 313/102 |
| 4,193,011 | 3/1980 | Pollehn et al. | 313/466 X |

*Primary Examiner*—Palmer C. Demeo

*Attorney, Agent, or Firm*—O'Brien & Marks

[57] ABSTRACT

An image intensifier tube has a light-absorbing electron-permeable layer covering an aluminum film overlying a layer of luminescent material in the anode structure of the tube. The light absorbing layer is silicon or boron, or a compound of silicon or boron, and has a thickness of about one-fourth the average wave length of light which impinges upon the photocathode during operation of the image intensifier tube.

3 Claims, 1 Drawing Figure

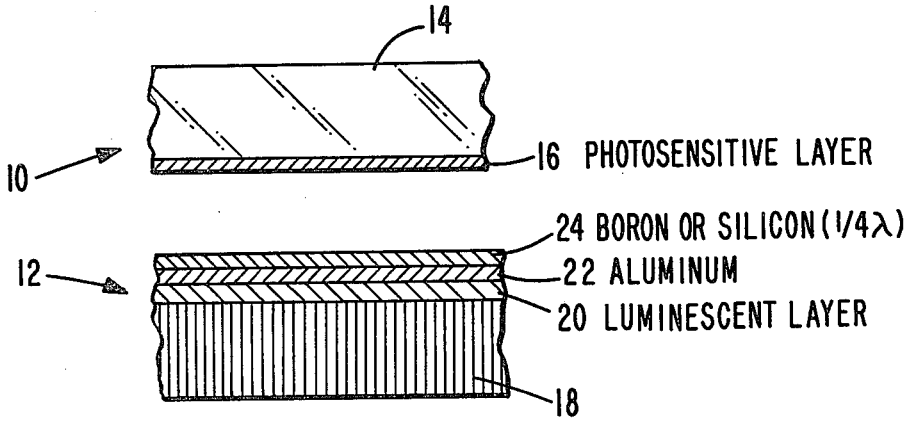
14
10
16 PHOTOSENSITIVE LAYER
24 BORON OR SILICON (1/4λ)
12
22 ALUMINUM
20 LUMINESCENT LAYER
18

IMAGE INTENSIFIER TUBE WITH A LIGHT-ABSORBING ELECTRON-PERMEABLE LAYER

CROSS-REFERENCE TO RELATED APPLICATION

This application is a divisional application of U.S. application Ser. No. 841,067 filed Oct. 11, 1977, now U.S. Pat. No. 4,201,797 for a Process For Applying A Light-Absorbing, Electron Permeable Layer Within an Image Intensifier Tube; said prior application in its entirety is hereby incorporated by reference herein.

TECHNICAL FIELD

This invention relates to image intensifier tubes.

DESCRIPTION OF THE PRIOR ART

Image intensifier tubes have spaced parallel photocathodes and anodes wherein an image impinging on a photocathode is reproduced with greater intensity on an anode. The photocathode includes a transparent substrate having a layer of light-responsive electron-emitting material thereon. The light forming the image passes through the cathode substrate and impringes upon the electron-emitting material to release electrons which are accelerated by an electric field toward the anode. The anode commonly includes a light transparent substrate, for example, a glass window or fiber optics plate, and a layer of electron responsive luminescent material applied to the substrate in the interior of the tube on the side facing the cathode. Normally, an aluminum film is provided to overlie the luminescent layer. The aluminum film permits the passage of electrons and has a number of functions, including the protection of the luminescent layer from the alkali metal vapors during the formation of the tube as well as the reflection of light which is directed back towards the photocathode and generated by the impingement of electrons on the luminescent layer.

It is clear the the aluminum film also reflects light that penetrates through the photocathode. This light is partly reflected back to the cathode, where it releases photoelectrons which have a deleterious effect and reduce the output image quality of the intensifier tube.

It is well known to provide a remedy for this effect by applying aluminum through evaporation in a nitrogen atmosphere, i.e., an atmosphere consisting in full or in part of nitrogen, and at a relatively low pressure within the range of approximately $10^{-1}$ to $10^{-2}$ torr. This procedure is productive of a black film, which substantially absorbs the light penetrating through the cathode. It has been found, however, that this process is difficult to perform and its results are poorly reproducable. Another difficulty of this method is that the parts surrounding the anode are contaminated.

OBJECTS AND SUMMARY OF THE INVENTION

It is an object of the present invention to construct a image intensifier eliminating the difficulties outlined above.

In accordance with this and other objects, the present invention is summarized in an image intensifier tube with a photocathode and an anode wherein a light-absorbing electron-permeable layer of boron or silicon is deposited on an aluminum film coated on a layer of luminescent material in the anode of the tube, the light absorbing layer having a thickness of approximately one-fourth the average wave length of light which during operation of the tube, impinges upon the photocathode thereof.

BRIEF DESCRIPTION OF THE DRAWINGS

The drawing is a cross sectional view of a broken away portion of a proximity-type image intensifier tube constructed in accordance with the invention.

DESCRIPTION OF THE PREFERRED EMBODIMENT

One embodiment in accordance with the invention has a photocathode indicated generally at 10 and a anode indicated generally at 12. The cathode 10 and anode 12 are portions of a sealed and evacuated structure with conventional electrode means for forming an electric field between the cathode and anode. The particular illustrated structure has the cathode 10 and anode 12 disposed in close proximity to each other to form an image-intensifier tube of the proximity focus type. The cathode structure 10 is a conventional structure including a transparent window or substrate 14 on which is disposed a light-responsive electron-emitting or photosensitive layer 16. The anode structure 12 includes a conventional transparent window or substrate 18 upon which are deposited a conventional electron-responsive luminescent layer 20 and a conventional aluminum film 22 overlying the luminesent layer.

The present proximity-type image intensifier tube differs from conventional proximity-type image intensifier tubes by including a thin light-absorbing electron-permeable layer 24 of a low atomic weight material on the aluminum layer of the anode facing the cathode structure. The layer 24 is boron, silicon, or a compound of boron or silicon and has a thickness of approximately one-fourth the average wave length of light which impinges upon the photocathode during operation of the tube. Good results are obtained when the layer 24 is formed by vacuum deposition in a vacuum in the range from approximately $10^{-5}$ to approximately $10^{-6}$ torr. After the various layers and films have been formed, the cathode structure 10 and anode structure 12 are sealed and evacuated in a conventional manner to complete the construction of the image intensifier tube.

In operation of the image intensifier tube, light forming an image passes through the window 14 and impinges on the photo-sensitive layer 16 releasing electrons therefrom. The electrons are accelerated between the cathode 10 and the anode 12 by an electric field. The electrons pass through the light-absorbing electron-permeable layer 24 and aluminum layer 22 to excite the luminescent layer 20 to generate an intensified image on the anode. Light generated within the luminescent layer 20 and directed back toward the photo-sensitive layer 16 is reflected by the aluminum layer 22 and prevented from passing back to the photocathode.

It is found that the light-absorbing electron-permeable layer 24, formed from boron, silicon, or a compound of boron or silicon and having a thickness of approximately one-fourth the average wave length of light which impinges upon the photo-sensitive layer absorbs the light passing through the photo-sensitive layer 16 and overcomes deficiencies of the prior art light-absorbing layers. In the absence of the light absorbing layer 24, the light passing through the photo-sensitive layer 16 would be reflected back by the aluminum layer 22 against the photosensitive layer 16 causing a deteriation of the sharpness of the image produced by the image intensifier tube due to scattering of the reflected light. The layer 24 has a low electron absorption due to its thinness and its formation from low atomic weight elements.

An additional advantage of the use of boron or silicon in the light-absorbing electron-permeable layer 24 is that they both have an extremely low vapor pressure. Thus during the manufacture of the tube employing temperatures in the order of 400° C., the high vacuum is not adversely affected. Thus the present invention results in a substantially improved image intensifier tube which can be manufactured in a simple, clean and reproducable manner.

It is noted that the thickness of the layer 24 need not be rigorously equal to one-fourth the wave length of the light impinging upon the photocathode thereof, but can be varied somewhat in order that optimum adaptation to the spectral transmission of the photocathode be achieved.

Although the present invention can be applied to other types of image intensifier tubes, its advantages are most prominent in image intensifier tubes of the so-called proximity-focus type. In proximity-focus type image intensifier tubes, the photocathode and anode are spaced a small distance from each other, as a consequence of which the chance generation of spurious electrons from reflected and scattered light passing through the photocathode, as noted above, is substantially greater than with image intensifier tubes wherein the anode and cathode structures are spaced substantial distances apart and wherein a much greater portion of the scattered reflected light will not reach the cathode.

Since the present invention is subject to many modifications, variations and changes in detail, it is intended that all matter in the forgoing description and shown in the accompanying drawings be interpreted as illustrative and not in a limiting sense.

I claim:

1. An image intensifier tube comprising a photocathode and an anode spaced from the photocathode wherein said anode includes a light transparent substrate, a layer of electron-responsive luminescent material on the light transparent substrate, an aluminum film on the layer of luminescent material, a light-absorbing electron-permeable layer of a low atomic weight meterial on the aluminum film, said light-absorbing electron-permeable layer having a thickness of about one-fourth the average wave length of light impinging on the photocathode of the image intensifier tube, and said low atomic weight material consisting of boron, silicon, or a compound of boron or silicon.

2. An image intensifier tube as claimed in claim 1 when said photocathode and said anode are disposed in close proximity to each other to form an image intensifier tube of the proximity-focus type.

3. An image intensifier tube as claimed in claim 1 or 2 wherein the light-absorbing electron-permeable layer is formed by vacuum deposition of low atomic weight material onto the aluminum film.

* * * * *